US006343642B1

(12) United States Patent
Miki

(10) Patent No.: US 6,343,642 B1
(45) **Date of Patent: *Feb. 5, 2002**

(54) RISER SLEEVE

(76) Inventor: Masamitsu Miki, 1-25-15, Nakahara, Mitaka-shi, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/159,621

(22) Filed: Sep. 24, 1998

(30) Foreign Application Priority Data

Oct. 1, 1997 (JP) ..... 9-268320

(51) Int. Cl.[7] ..... B22C 9/08

(52) U.S. Cl. ..... 164/359; 164/360; 164/244; 164/246

(58) Field of Search ..... 164/359, 358, 164/360, 244, 246, 35

(56) References Cited

U.S. PATENT DOCUMENTS 3,835,913 A * 9/1974 Vandemark et al. ..... 164/244
5,299,625 A * 4/1994 Miki ..... 164/359
5,425,410 A * 6/1995 Reynolds ..... 164/358

* cited by examiner

*Primary Examiner*—Nam Nguyen
*Assistant Examiner*—I.-H. Lin
(74) *Attorney, Agent, or Firm*—Wenderoth, Lind & Ponack, L.L.P.

(57) ABSTRACT

A riser sleeve has a sleeve body and an evaporative pattern fit into the sleeve body to pass through a side wall thereof. The evaporative pattern is shaped to enable the casting, integrally with the riser cast by the sleeve body, of a projecting portion capable of receiving a wedge blade of an openable wedge blade type riser breaker. Even a top riser can therefore be broken off of the main casting at a neck portion by an opening force applied to the wedge blades of the riser breaker without the use of a special jig.

5 Claims, 6 Drawing Sheets

RISER SLEEVE

BACKGROUND OF THE INVENTION

1. Field of the Invention

This invention relates to a riser sleeve structured so that when used in casting, the riser is cast integrally with a projecting portion for receiving one wedge blade of a riser breaker of the type that breaks a riser off of a main casting at a neck portion of the riser by an opening force applied between a pair of opposing wedge blades (this type of breaker being hereinafter called an "openable wedge blade type riser breaker").

2. Description of the Prior Art

In the production of castings, the openable wedge blade type riser breaker (taught by, for example, Japanese Utility Model Publication No. Hei 2-31250 and Japanese National-Publication No. 56-500247) is widely used for breaking the riser (and/or runner) off of the main casting. This breaker has been extensively adopted owing to its ability to upgrade casting efficiency and markedly improve the working environment.

Up to now, however, this type of breaker has been limited in application. In use, its pair of opposing wedge blades are inserted between the main casting and a side surface of the riser and force is applied to the wedge blades to separate them and break off the riser. The breaker is therefore suitable for use with a side riser, which the wedge blades can secure a hold on, but cannot be used with a top riser (a riser formed on top of the main casting) because, even if one of the wedge blades can be seated on top of the main casting, no appropriate projection is present to offer a hold for the other of the paired wedge blades.

It has been proposed to overcome this problem occurring in the case of the top riser by using a jig that serves as a projection providing a wedge blade seat. This would be extremely uneconomical, however, in view of the need to stock countless jigs corresponding to castings of many and varied shapes. Moreover, since a jig would have to be installed on each casting, a complex and time-consuming jig installation step, highly inappropriate for industrial production, would be necessary.

Cleaving of the top riser at a reduced-diameter neck portion is commonly facilitated by giving the riser sleeve a vertical sectional configuration narrowing toward the bottom in a V- or U-like shape or by installing a neck-down core at the bottom of the riser sleeve. In the case of ordinary cast iron, these techniques enable the riser to be detached easily with a hammer or the like, but in the case of cast steel, which, unlike ordinary cast iron, has high-strength material properties, the practice has been to remove the riser by flame cutting with a gas torch or by striking it with a large hammer. For similar reasons, a large hammer is also used for riser removal in the case of cast ductile steel. The work of knocking a riser off manually with a large hammer is not only extremely dangerous for the worker concerned, but it further produces undesirable working conditions for many other workers in the vicinity. It also degrades the general working environment.

These circumstances have made it difficult to enjoy the considerable improvement in casting yield offered by the top riser casting method and forced adoption of the side riser method instead.

SUMMARY OF THE INVENTION

An object of the invention is therefore to provide a riser sleeve capable of imparting a top riser with a shape enabling use of an openable wedge blade type riser breaker for detachment of the top riser directly, without use of a special jig.

To achieve this object, the invention provides a riser sleeve comprising a sleeve body and an evaporative pattern fit into the sleeve body to pass through a side wall thereof, the evaporative pattern being shaped to enable casting, integrally with a riser cast by the sleeve body, of a projecting portion capable of receiving a wedge blade of an openable wedge blade type riser breaker for breaking a riser off a main casting at a neck portion by an opening force applied to a pair of wedge blades.

The riser sleeve can be a blind riser sleeve or an open riser sleeve.

The blind or open riser sleeve can be configured to have a cross-section taken along its vertical axis that narrows toward the bottom in a V- or U-like shape.

The riser sleeve of any of the foregoing configurations can be provided at its bottom with a neck-down core.

DETAILED DESCRIPTION OF THE PREFERRED EMBODIMENTS

The invention will be explained with reference to the drawings.

Figure 1:
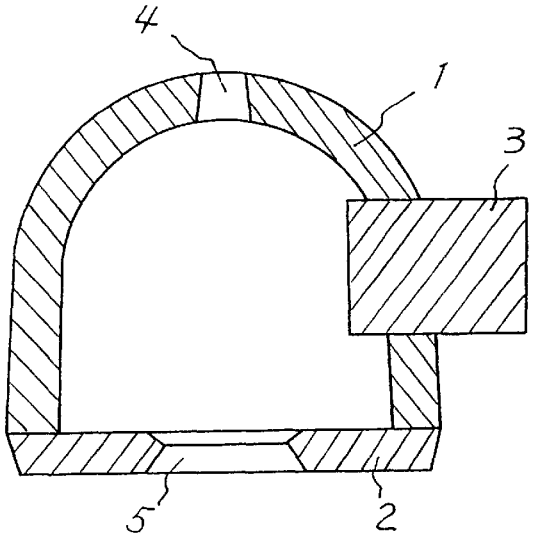
FIG. 1 is a sectional view of a blind riser sleeve that is an embodiment of a riser sleeve according to the invention.

FIG. 1 a sectional view of a blind riser sleeve that is an embodiment of the riser sleeve according to the invention.

The blind riser sleeve has a riser sleeve body 1 fabricated by shaping and drying a mixture of powdered/granular refractory, exothermic material (if required) and appropriate binder. The sleeve body 1 has a vent 4 at the crown. An evaporative pattern 3 made of foamed styrol, wax, pulp or other such material dissipated by the heat of the cast melt is fit into the sleeve body 1 to pass through its side wall. The lost pattern 3 can be of circular, rectangular or any other desired sectional shape.

A neck-down core 2 provided at the bottom of the sleeve body 1 has a central neck-forming hole 5. As viewed in a section through the thickness of the neck-down core 2, the periphery of the neck-forming hole 5 projects inward like a wedge. The neck-down core 2 is also fabricated by shaping and drying a mixture of powdered/granular refractory, exothermic material (if required) and appropriate binder.

When a melt is poured into a casting mold fabricated using the invention riser sleeve configured as shown in FIG. 1, the melt dissipates the evaporative pattern 3 by its heat and flows into the void resulting from the dissipation. A projecting portion 8 is therefore cast integrally with a top riser 6, as shown in FIG. 2.

Figure 2:
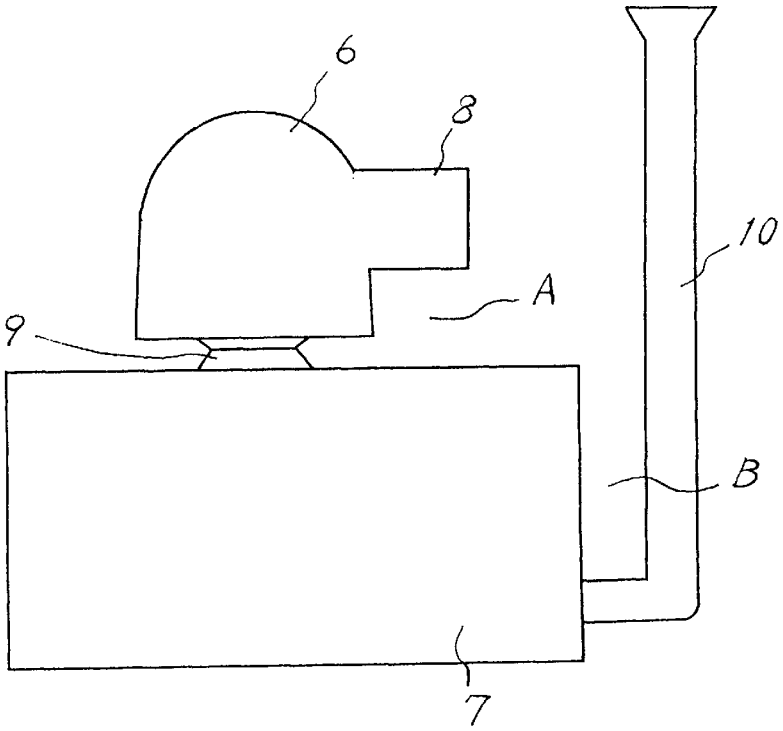
FIG. 2 is a sectional view showing the result of conducting casting with a mold made using the invention riser of FIG. 1 after removal of only the mold frame and the foundry sand.
Figure 2A:
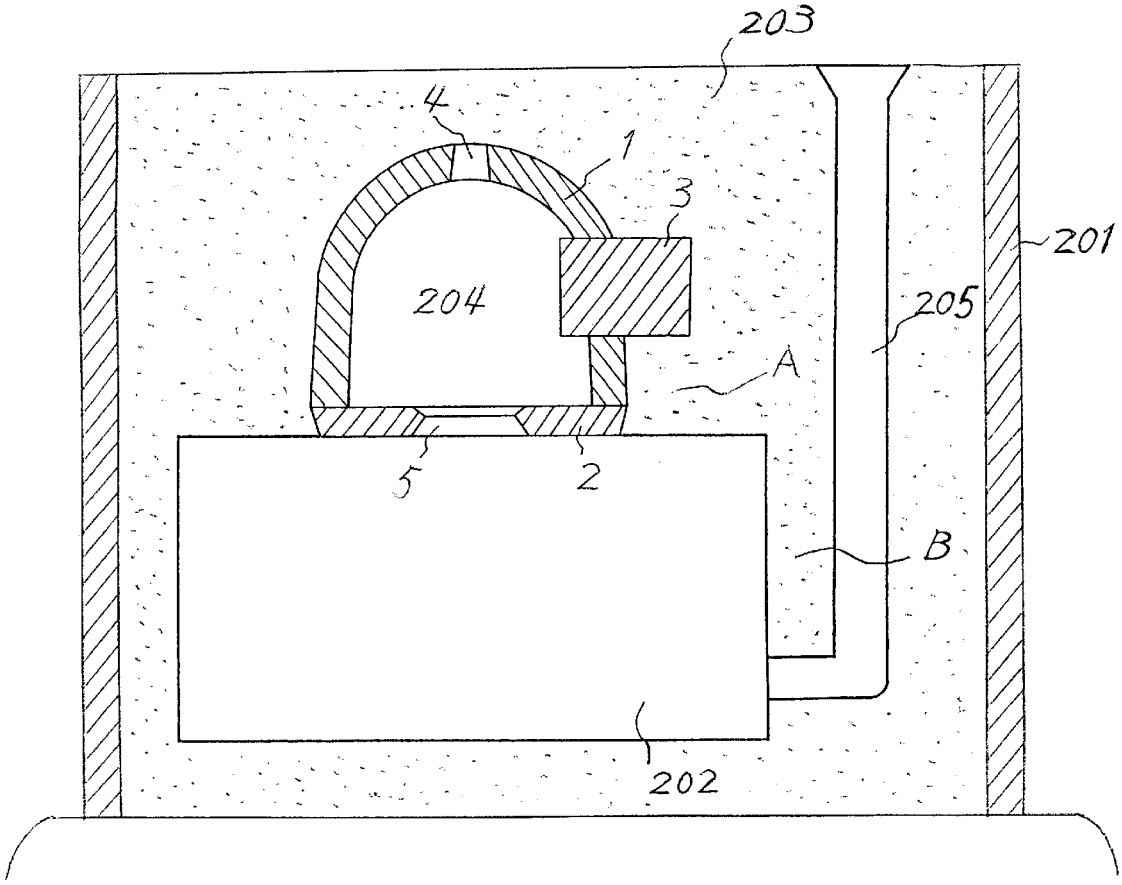
Figure 2B:
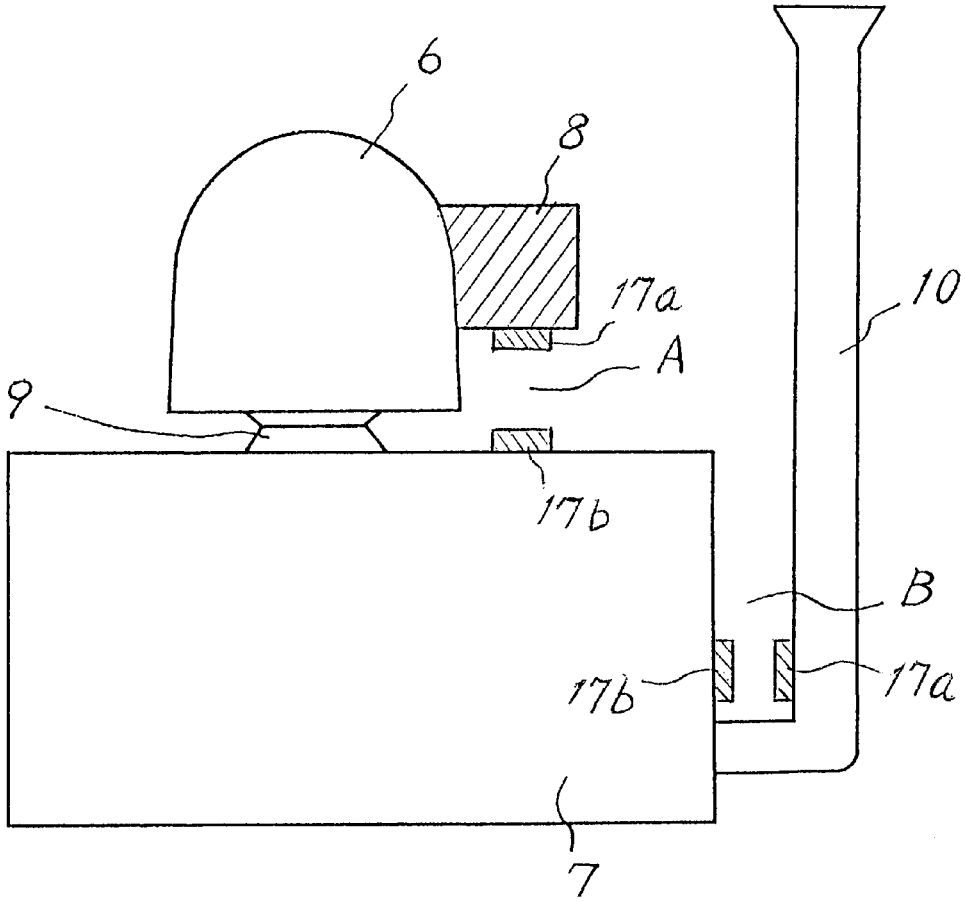

FIG. 2 is a sectional view showing the result of conducting casting with a mold made using the invention riser of FIG. 1, after removal of the mold frame and the foundry sand but before breaking off the riser and the runner.

In addition to the top riser 6 and the projecting portion 8, FIG. 2 also shows the main casting 7, a neck portion 9 produced by the wedge-like shape of the neck-forming hole 5 and a runner 10.

When the invention riser sleeve is used, a gap A is formed between the projecting portion 8 integral with the top riser 6 and the upper surface of the main casting 7. The neck portion 9 can therefore be easily broken to detach the riser by inserting the wedge blades of an openable wedge blade type riser breaker into the gap A with one wedge blade against the surface of the main casting 7 and the other against the projecting portion 8 and then applying an opening force to the wedge blades.

The runner 10 can be similarly broken and separated from the main casting 7 by inserting the wedge blades of the breaker into the gap B between the runner 10 and the main casting 7 and opening the wedge blades.

Figure 3:
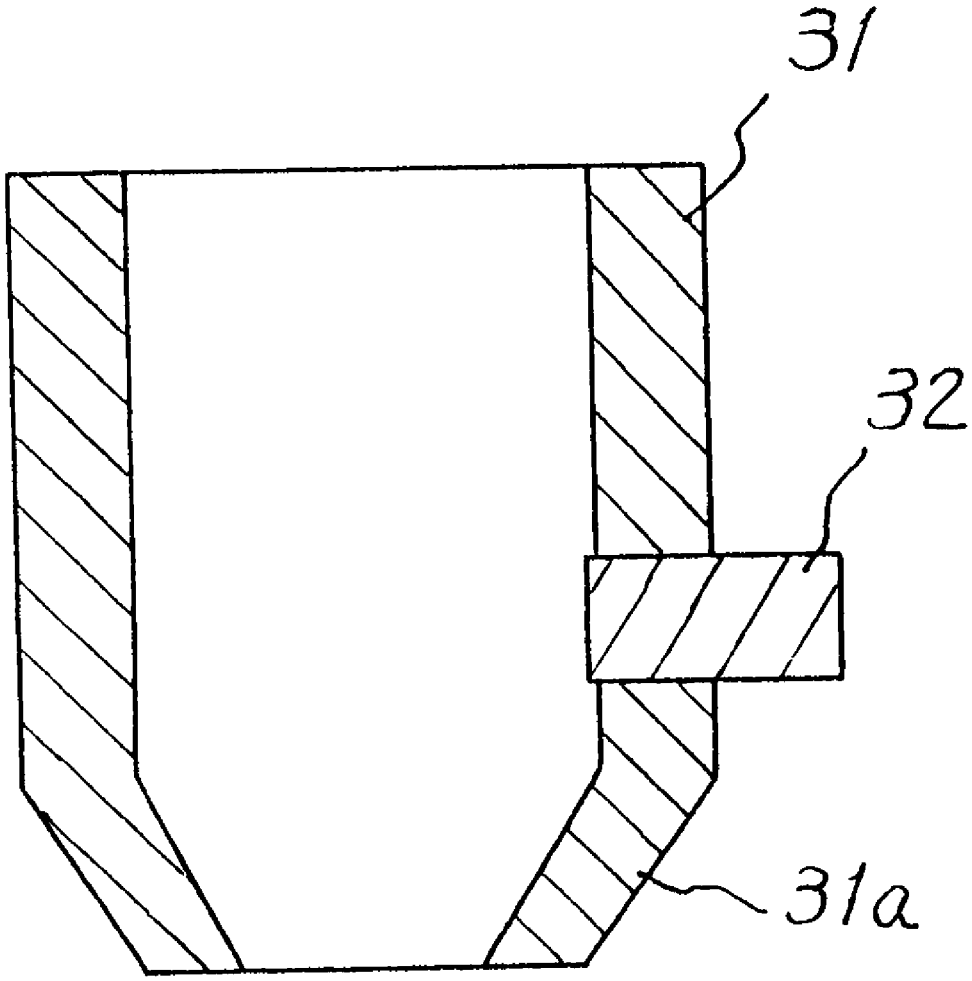
FIG. 3 is a sectional view of an open riser sleeve that is an embodiment of a riser sleeve according to the invention.

The riser sleeve is not limited to the blind type shown in FIG. 1. Various other types of riser sleeves can also be configured according to the invention, such as the open riser sleeve shown in sectional view in FIG. 3. The open riser sleeve of FIG. 3 has an open main riser sleeve body 31 including a tapered section 31*a* that, as viewed in a cross-section taken along the vertical axis, narrows toward the bottom in a V-like shape. The riser sleeve configuration according to the invention is completed by fitting an evaporative pattern 32 into the open riser sleeve body 31 to pass through its side wall. When a desired casting is produced by pouring a melt into a top riser type casting mold made using this riser sleeve, there is obtained a casting having a top riser with a projecting portion integrally cast on the side surface of the riser. The top riser can therefore be easily broken off of the main casting by inserting the wedge blades of an openable wedge blade type riser breaker into the gap between this projection and the main casting and applying an opening force to the wedge blades.

A preferred configuration of the openable wedge blade type riser breaker used to break the riser off the main casting when a casting is produced using a top-riser type casting mold fabricated using the invention riser sleeve will now be explained with reference to drawings taken from Japanese Utility Model Publication No. Hei 2-31250, which relates to a casting neck breaker (corresponding to the openable wedge blade type riser breaker referred to in the foregoing description of the invention).

Figure 4:
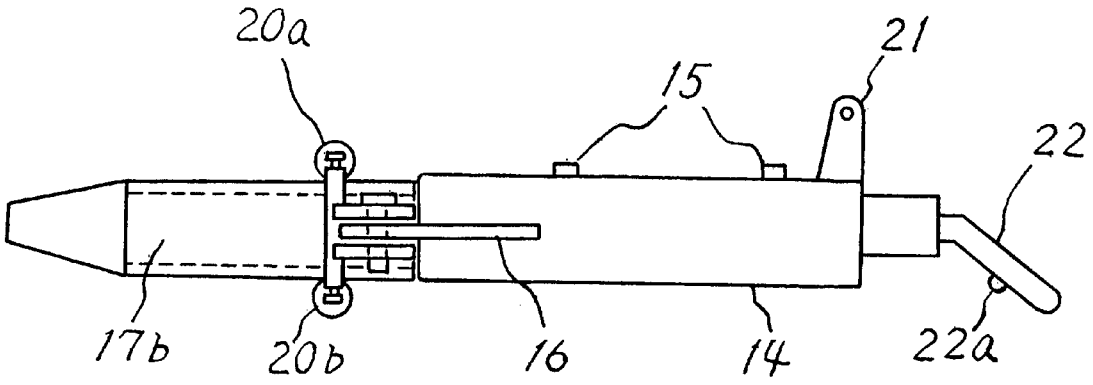
FIG. 4 is a side view of an openable wedge blade type riser breaker taught by Japanese Utility Model Publication No. Hei 2-32150.
Figure 5:
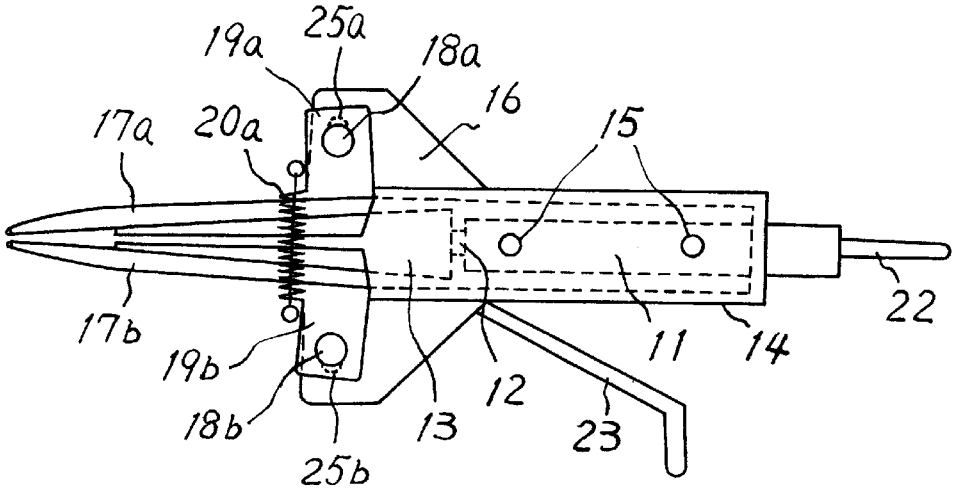
FIG. 5 is a plan view showing the riser breaker in a closed condition.
Figure 6:
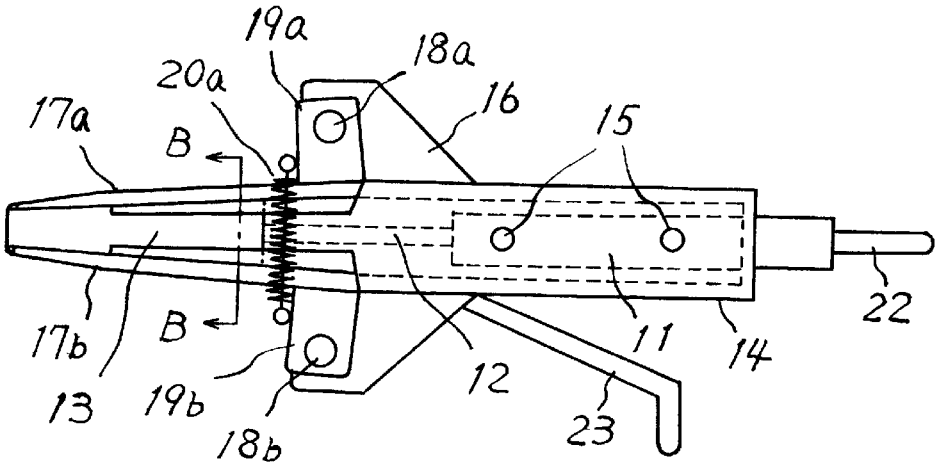
FIG. 6 is a plan view showing said riser breaker in an opened condition.

FIG. 4 is a side view of an openable wedge blade type riser breaker; FIG. 5 is a plan view showing the riser breaker in the closed condition; FIG. 6 is a plan view showing the riser breaker in the opened condition; and FIG. 7 is a sectional view taken along line B—B in FIG. 6.

Figure 7:
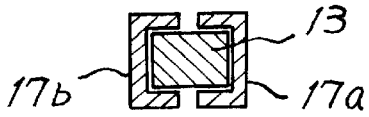
FIG. 7 is a sectional view taken along line B—B in FIG. 6.

In these figures, reference numeral 11 designates a hydraulic cylinder, 12 a cylinder rod, 13 a wedge-shaped slider, 14 a housing, 15 hydraulic hose connection sockets (for supplying high-pressure hydraulic fluid from a hydraulic unit (not shown)), 16 check plates, 17*a* and 17*b* wedge blades of U-like section as shown in FIG. 7, 18*a*, 18*b* pins, 19*a*, 19*b* hinges, 20*a*, 20*b* springs, 21 a hanger, 22 an operating handle, 22*a* a switch, 23 an auxiliary handle, and 25*a*, 25*b* hinge holes passing through the check plates 16. The hinge holes 25*a*, 25*b* are elongate holes that enable the hinges 19*a*, 19*b* to move apart together with the wedge blades 17*a*, 17*b*.

The operation of this riser breaker will now be explained. The riser breaker is suspended from a movable hoist by the hanger 21 with tips of the wedge blades 17*a*, 17*b* pointed downward. With the riser breaker in this suspended state, the operator grasps the operating handle 22 with one hand and the auxiliary handle 23 (for sway prevention) with the other and inserts the tips of the wedge blades into the gap between the main casting and the riser. The operator then presses the switch 22*a* on the operating handle 22. This operates the hydraulic cylinder 11 to advance the tip of the wedge-shaped slider 13 to near the tips of the wedge blades. As a result, the wedge blades are forced outward in parallel by the force received from the opposite surfaces of the wedge-shaped slider 13 in contact therewith. The space between the wedge blade tips therefore expands to press one of the wedge blades against the main casting and the other against the riser. As the load of the hydraulic cylinder 11 is further increased, the opening force of the wedge blades breaks the riser off the main casting at the neck portion.

When the riser sleeve according to this invention is adopted, even a top riser can be easily broken off the main casting by an openable wedge blade type riser breaker without use of any special means such as a jig. The invention therefore has a high degree of industrial utility.

What is claimed is:

1. A riser sleeve for use with a casting mold, the casting mold being used to form a main casting, said riser sleeve comprising:

a riser sleeve body having a side wall; and an evaporative pattern fitted into said riser sleeve body so as to pass through said side wall of said riser sleeve body and projecting from said side wall outside of said riser sleeve body;

wherein said evaporative pattern is shaped and located on said riser sleeve body such that when a melt is poured into the casting mold using said riser sleeve body and having said evaporative pattern, the melt dissipates said evaporative pattern and casts a projecting portion corresponding to said evaporative pattern integrally with a riser cast by said riser sleeve body, the projecting portion being capable of receiving a wedge blade of an openable wedge blade type riser breaker for breaking the riser off of the main casting by an opening force being applied to a pair of wedge blades of the riser breaker.

2. The riser sleeve of claim 1, wherein said riser sleeve is selected from the group consisting of a blind riser sleeve and an open riser sleeve.

3. The riser sleeve of claim 1, wherein a cross-section taken along a vertical axis of said riser sleeve narrows toward a bottom of said riser sleeve in a V or U shape.

4. The riser sleeve of claim 3, and further comprising a neck-down core provided at a bottom of said sleeve body.

5. The riser sleeve of claim 1, and further comprising a neck-down core provided at a bottom of said sleeve body.

* * * * *